US005590731A

United States Patent [19]

Jacobson

[11] Patent Number: 5,590,731

[45] Date of Patent: Jan. 7, 1997

[54] HYDRAULIC CONTROL SYSTEM PROVIDING PROPORTIONAL MOVEMENT TO AN ATTACHMENT OF A POWER MACHINE

[75] Inventor: Scott B. Jacobson, Kindred, N. Dak.

[73] Assignee: Clark Equipment Company, Woodcliff Lake, N.J.

[21] Appl. No.: 435,601

[22] Filed: May 5, 1995

[51] Int. Cl.[6] ..... B60K 25/00

[52] U.S. Cl. ..... 180/53.4; 180/306; 180/900; 364/424.07; 60/422; 37/403

[58] Field of Search ..... 172/2; 37/348, 37/403; 91/511, 514, 532; 60/368, 422; 364/424.07, 424.01, 424.03, 424.05; 180/53.1, 53.4, 324, 331, 306, 333, 313, 900

[56] References Cited

U.S. PATENT DOCUMENTS

| | | | |
|---|---|---|---|
| 3,874,407 | 4/1975 | Griswold | 137/596.17 |
| 4,013,875 | 3/1977 | McGlynn | 364/424.07 |
| 4,373,697 | 2/1983 | Phelps | 251/129 |
| 4,583,760 | 4/1986 | Halstensgaard et al. | 280/766.1 |
| 4,746,094 | 5/1988 | Cummins | 251/129.14 |
| 4,755,100 | 7/1988 | Schultz et al. | 180/315 X |
| 4,765,587 | 8/1988 | Cummins | 251/129.19 |
| 4,870,892 | 10/1989 | Thomsen et al. | 91/361 |
| 4,949,805 | 8/1990 | Mather et al. | 180/333 |
| 5,052,174 | 10/1991 | Bak | 60/39.281 |
| 5,118,077 | 6/1992 | Miller et al. | 251/129.15 |
| 5,174,115 | 12/1992 | Jacobson et al. | 180/331 X |
| 5,182,908 | 2/1993 | Devier et al. | 91/532 X |
| 5,202,813 | 4/1993 | Uota et al. | 361/154 |
| 5,423,654 | 7/1995 | Rohrbaugh | 180/306 X |
| 5,442,868 | 8/1995 | Ahn | 364/424.07 X |

OTHER PUBLICATIONS

"Compact Maneuverable" Angel Broom Attachment, Melroe Company, B–1619 Bobcat, 50 Series, Melroe Company, B–1633.

*Primary Examiner*—Brian L. Johnson
*Assistant Examiner*—Victor E. Johnson
*Attorney, Agent, or Firm*—Westman, Champlin & Kelly, P.A.

[57] ABSTRACT

A skid steer loader is adaptable to be used with a hydraulically powered attachment. A hydraulic system in the skid steer loader includes a hydraulic circuit providing fluid under pressure. A first auxiliary control valve is coupled to the hydraulic circuit and is movable between a full open position and a full closed position, and is couplable to the attachment. An operator input device provides a variable operator input signal. A controller is coupled to the operator input device and to the first auxiliary control valve. The controller controls the first auxiliary control valve to move a portion of the way between the full open position and the full closed position based on the operator input signal. This provides smoother control over systems which merely operated the auxiliary control valve in a full open or full closed manner.

10 Claims, 6 Drawing Sheets

HYDRAULIC CONTROL SYSTEM PROVIDING PROPORTIONAL MOVEMENT TO AN ATTACHMENT OF A POWER MACHINE

BACKGROUND OF THE INVENTION

The present invention deals with power machines such as skid steer loaders. More particularly, the present invention deals with control systems in such power machines.

Power machines, such as skid steer loaders, typically have a frame which supports a cab or operator compartment and a movable lift arm which, in turn, supports a work tool such as a bucket. The movable lift arm is pivotably coupled to the frame of the skid steer loader and is powered by power actuators which are commonly hydraulic cylinders. In addition, the tool is coupled to the lift arm and is powered by one or more additional power actuators which are also commonly hydraulic cylinders. An operator manipulating a skid steer loader raises and lowers the lift arm, and manipulates the tool, by actuating the hydraulic cylinders coupled to the lift arm, and the hydraulic cylinder coupled to the tool.

Skid steer loaders also commonly have an engine which drives a hydraulic pump. The hydraulic pump powers hydraulic traction motors which provide powered movement of the skid steer loader. The traction motors are commonly coupled to the wheels through a drive mechanism such as a chain drive.

Front attachments, such as augers or angle brooms, typically include their own hydraulic drive motors and are attachable or mountable to the lift arm. An auxiliary hydraulic system is used to control the flow of hydraulic fluid between a hydraulic pump on the loader and the hydraulic motor on the front mounted attachment. In one known system, the flow of hydraulic fluid to the motor on a front mounted attachment is controlled by an electronic control valve which is operated in an either fully opened or fully closed fashion. In other words, if the operator actuates an operator input, a signal is provided to a solenoid on the electronic control valve either opening or closing the control valve to either provide, or discontinue, full flow of hydraulic fluid to the hydraulic motor on the front mounted attachment.

In addition, rear mounted attachments, such as stabilizers, are commonly attached or mounted to a rear portion of the loader. The rear mounted attachments also typically include their own hydraulic motors and are also supplied with hydraulic fluid from a pump which is controlled by an auxiliary hydraulic system on the loader.

In one prior skid steer loader, only a single auxiliary hydraulic power circuit is provided and a diverter valve is provided to route hydraulic fluid from the front mounted attachment to the rear mounted attachment. Thus, either the front or rear mounted attachment is operable at one time. In another prior loader, the auxiliary hydraulic power circuit is configured to allow simultaneous operation of both front and rear mounted attachments.

It is also common for control levers in skid steer loaders to have hand grips which support a plurality of buttons or actuable switches, actuable by the operator to perform certain functions. Depending upon the particular type of attachment or attachments mounted on the skid steer loader, certain functions may be disabled or unusable. Further, depending upon the particular type of attachment or attachments mounted on the skid steer loader, certain combinations of inputs from the operator input devices, when performed simultaneously, can result in opposing control valves being opened. This essentially provides an equal amount of pressurized fluid to both sides of a hydraulic actuator or hydraulic motor.

There is a continuing need for improved hydraulic control systems in such power machines to enhance performance of the machines.

SUMMARY OF THE INVENTION

A skid steer loader is adaptable to be used with a hydraulically powered attachment. A hydraulic system in the skid steer loader includes a hydraulic circuit providing fluid under pressure. A first auxiliary control valve is coupled to the hydraulic circuit and is movable between a full open position and a full closed position, and is couplable to the attachment. An operator input device provides a variable operator input signal. A controller is coupled to the operator input device and to the first auxiliary control valve. The controller controls the first auxiliary control valve to move a portion of the way between the full open position and the full closed position based on the operator input signal. This provides smoother control over systems which merely operate the auxiliary control valve in a full open or full closed manner.

In another embodiment of the present invention, a plurality of operator input devices are provided wherein each operator input device, when activated, indicates that the operator desires a certain operation to be performed. The controller is coupled to the operator input devices and the control valves. The controller controls the control valves such that, when the plurality of operator input devices are activated to simultaneously indicate a plurality of desired operations, then the operations are performed according to a predetermined priority.

In yet another embodiment of the present invention, an attachment which is removably mounted to a portion of the skid steer loader is provided with an attachment circuit. The attachment circuit provides an attachment signal to the controller indicating the type of attachment which is mounted to the skid steer loader. The controller then assigns certain operations to certain of the operator input devices based on the type of attachment indicated by the attachment signal. This essentially allows the controller to customize the operator input devices for each type of attachment mounted to the skid steer loader. In the preferred embodiment, the attachment circuit provides the attachment signal to the controller in response to certain operator inputs. In other words, if the operator actuates one of the operator input devices, the attachment circuit provides the attachment signal in response to that operator input signal.

DETAILED DESCRIPTION OF THE PREFERRED EMBODIMENTS

Figure 1:
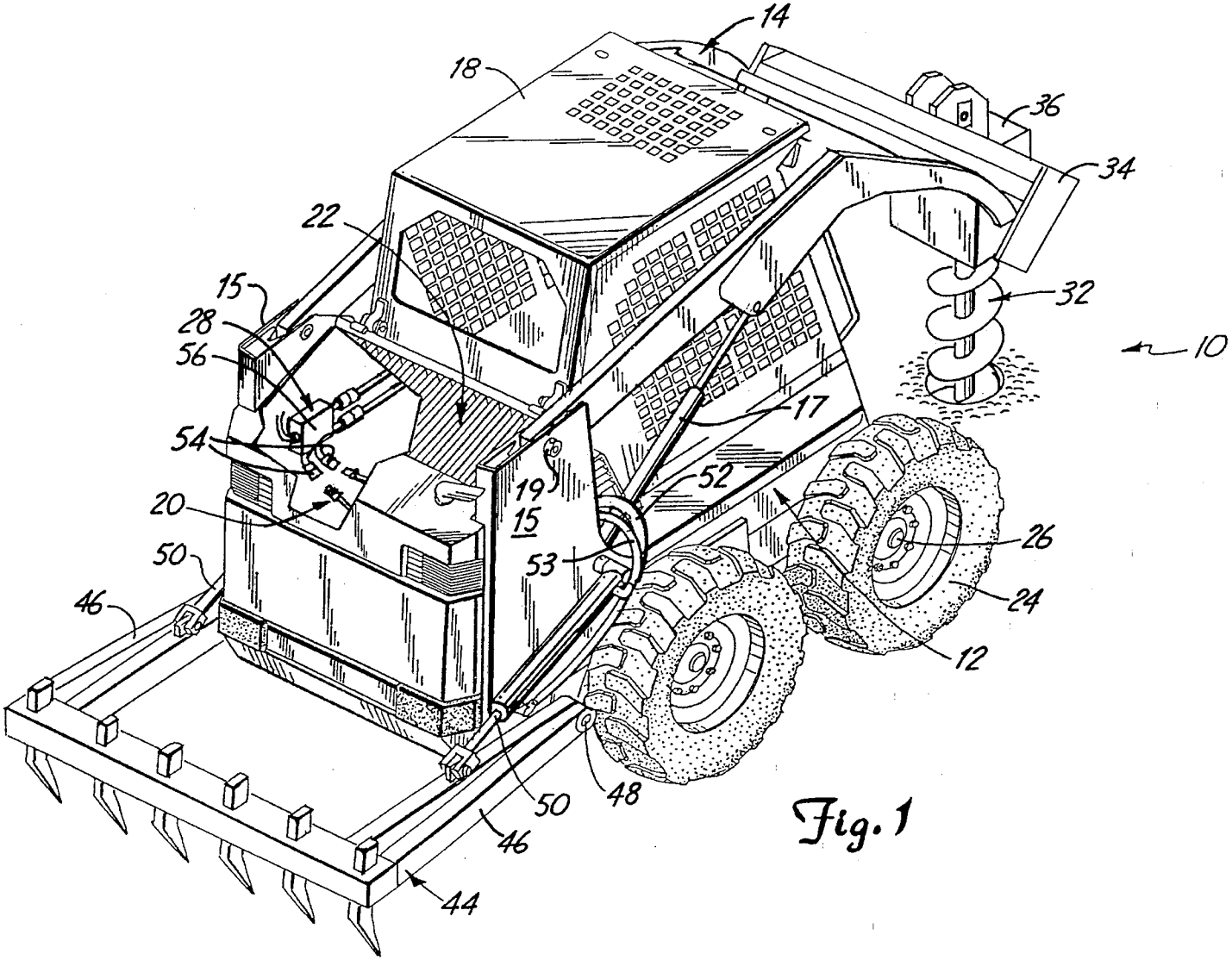
FIG. 1 is a perspective view taken from the right rear side of a skid steer loader according to the present invention.
Figure 2:
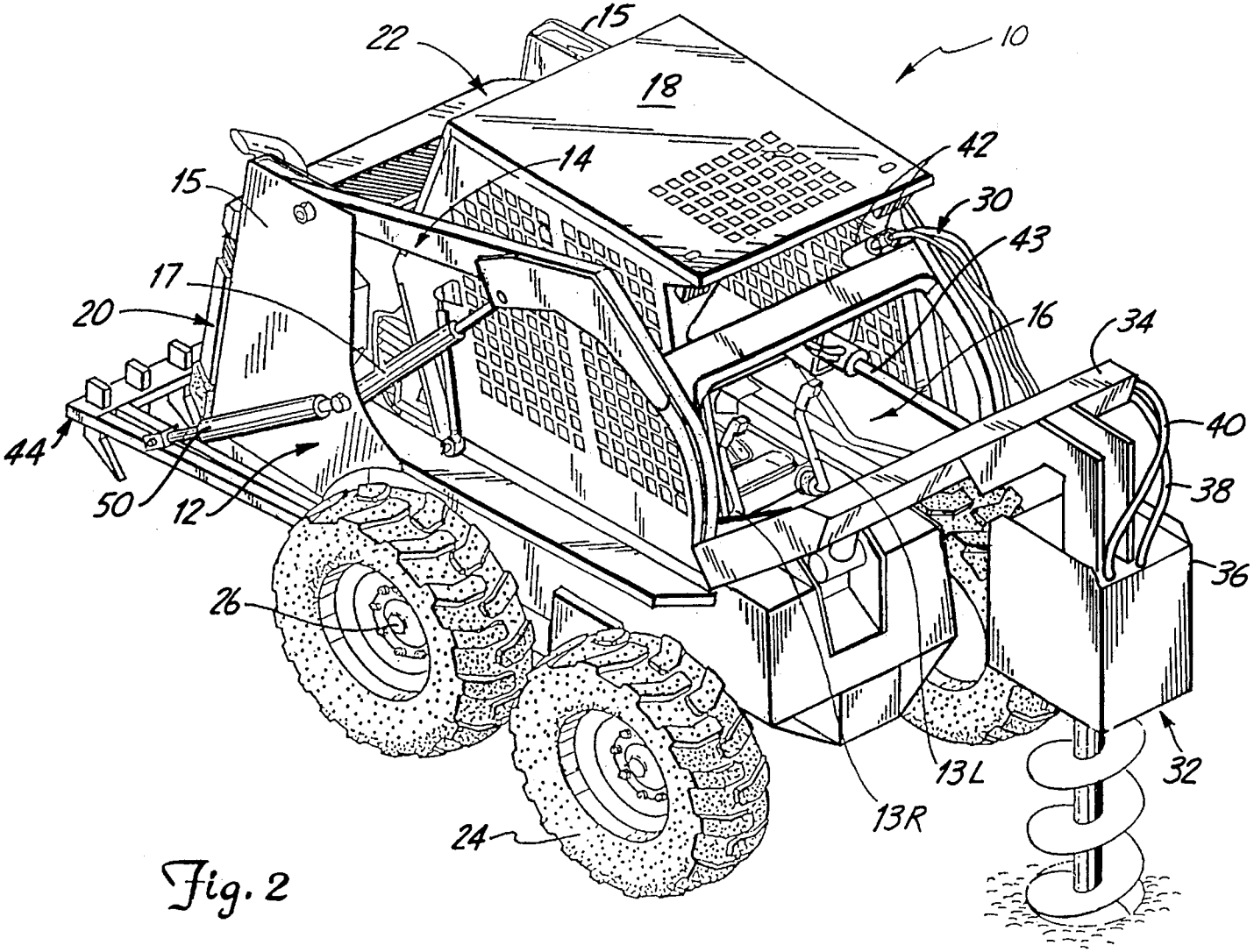
FIG. 2 is an illustration of the loader shown in FIG. 1 taken from the right front side.

FIGS. 1 and 2 illustrate a skid steer loader 10 according to the present invention. Loader 10 includes a main frame assembly 12 which is preferably mounted to a lower frame assembly or transmission case (not shown). Loader 10 also includes lift arm 14, operator compartment 16, preferably defined by a cab 18, engine compartment 20, heat exchanger compartment 22, and wheels 24 preferably mounted to main frame assembly 12 by stub axles 26. FIG. 1 also has a portion of engine compartment 20 and heat exchanger compartment 22 cut away to reveal a portion of a rear auxiliary hydraulic circuit 28. Further, FIG. 2 shows a portion of a front auxiliary hydraulic circuit 30.

Lift arm 14 is pivotably attached to upright portions 15 of main frame assembly 12 at pivot points 19. A pair of hydraulic actuators 17 are also coupled to lift arm 14 and main frame assembly 12. When the operator of loader 10 causes hydraulic actuators 17 to extend, lift arm 14 pivots about pivot points 19 in an upward direction. Similarly, when the operator of loader 10 operates the loader to cause hydraulic actuator 17 to retract, lift arm 14 pivots about pivot points 19 in a downward or lowered direction.

Loader 10 in FIGS. 1 and 2 is depicted with both a front attachment and a rear attachment. The front attachment is auger 32 which is mounted to lift arm 14 by a front attachment mount 34. Auger 32 includes a hydraulic motor (not shown) housed in motor housing 36. Hydraulic power is preferably provided to the hydraulic motor in auger 32 through hoses 38 and 40 which are coupled to the front auxiliary hydraulic circuit 30 by hose coupling mechanisms 42.

The hydraulic motor located in housing 36 powers rotation of auger 32. By selectively providing fluid under pressure through hoses 38 and 40, the direction of rotation of auger 32 is controlled in a known manner.

A pair of front auxiliary control valves are provided in front auxiliary hydraulic control circuit 30. The front auxiliary control valves are described in more detail with respect to FIG. 7. Briefly, the front auxiliary control valves variably control the flow of hydraulic fluid through hoses 38 and 40 to the motor in motor housing 36 to accomplish desired rotation of auger 32.

A tilt cylinder 43 is also coupled to both main frame assembly 12 and auger 32. Auger 32 is pivotably mounted by front mounting attachment 34 to lift arm 14. Therefore, when the operator of loader 10 causes tilt cylinder 43 to retract, this causes auger 32 to rotate relative to lift arm 14 in an upward and outward direction. Similarly, when the operator of loader 10 causes tilt cylinder 43 to extend, this causes auger 32 to rotate relative to lift arm 14 inwardly toward loader 10.

The rear mounted attachment shown in FIGS. 1 and 2 is a rear scarifier 44 which includes a pair of generally parallel elongate members 46 which are pivotably attached to main frame assembly 12 at pivot points 48. Sacrificer 44 is also attached to uprights 15 by a pair of hydraulic cylinders 50 (i.e., linear hydraulic motors). Hydraulic cylinders 50 are controllable by the operator of loader 10 to raise and lower scarifier 44 in an arc about pivot points 48. The hydraulic fluid is provided to cylinders 50 through hoses 52 and 53 which are couplable to rear auxiliary hydraulic circuit 28 through hydraulic hose coupling members 54. Rear auxiliary hydraulic control circuit 28 includes one or more electrically actuable control valves housed in valve housing 56. The operation of the control valves is explained in greater detail with respect to FIG. 7. Briefly, the control valves control the provision of hydraulic fluid to cylinders 50 through hoses 52 to accomplish desired operations.

FIG. 2 shows operator control handles 13R and 13L in operator compartment 16. Control handles 13R and 13L can be moved in a forward and rearward direction to control the speed and direction of rotation of wheels 24 in a known manner.

Figure 3:
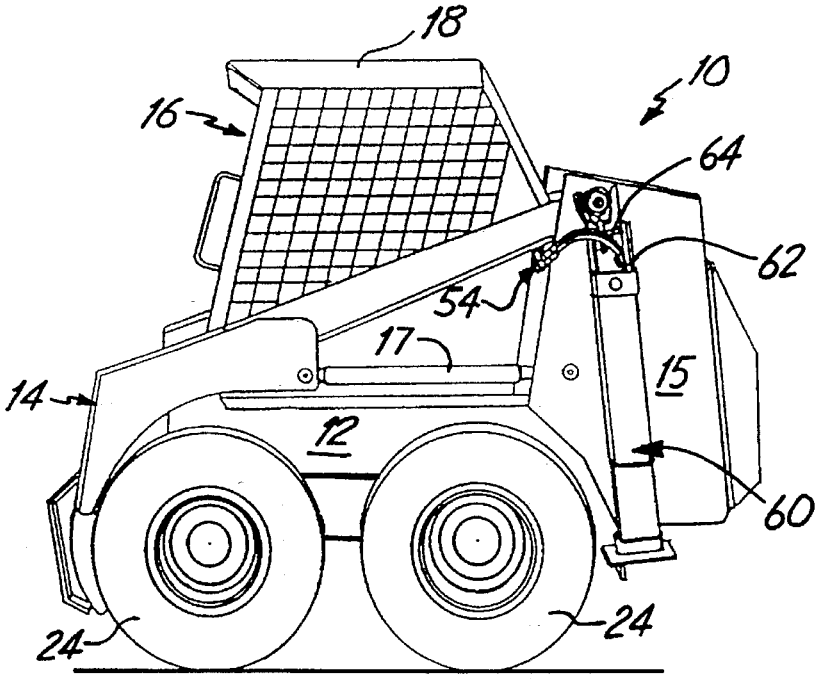
FIG. 3 is a side view of a skid steer loader according to the present invention having stabilizers in a first position mounted to a rear portion of the skid steer loader.
Figure 4:
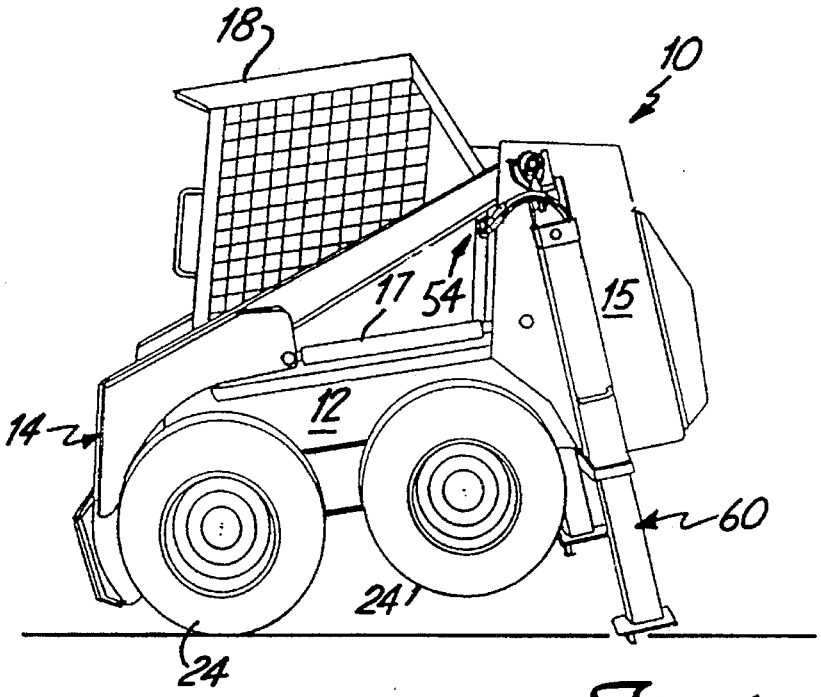
FIG. 4 is a side view of the skid steer loader shown in FIG. 3 with the stabilizers in a second position.

FIGS. 3–6 illustrate loader 10 with other front and rear mounted attachments. FIGS. 3 and 4 illustrate loader 10 with auger 32 and scarifier 44 removed, and with stabilizers 60 attached or mounted to a rear portion of loader 10. Stabilizers 60 are driven by a pair of hydraulic cylinders which receive hydraulic fluid under pressure through hoses 62 and 64. FIG. 3 shows stabilizers 60 in a first retracted position, while FIG. 4 shows stabilizers 60 in a second, extended position. When the operator of loader 10 desires to extend stabilizers 60 from the position shown in FIG. 3 to that shown in FIG. 4, the operator causes the rear auxiliary control valves housed in valve housing 56 to allow fluid under pressure to flow to the hydraulic cylinders powering stabilizers 60 causing them to extend. By contrast, when the operator of loader 10 desires stabilizers 60 to retract into the position shown in FIG. 3, the operator controls the rear auxiliary control valves to cause hydraulic fluid to flow to the hydraulic cylinders powering stabilizers 60 causing stabilizers 60 to retract.

Figure 5:
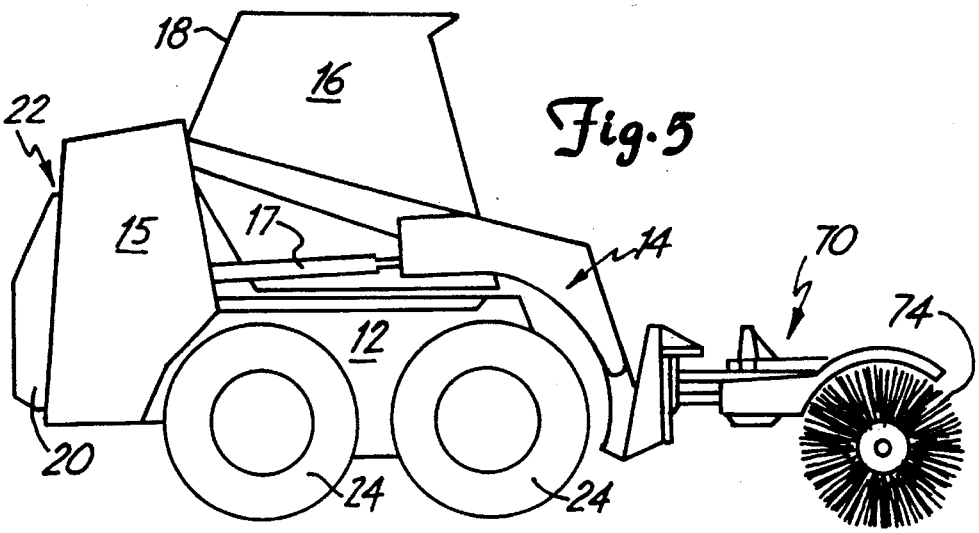
FIG. 5 is a side view of a skid steer loader having an angle broom mounted to a front portion of the skid steer loader.
Figure 6:
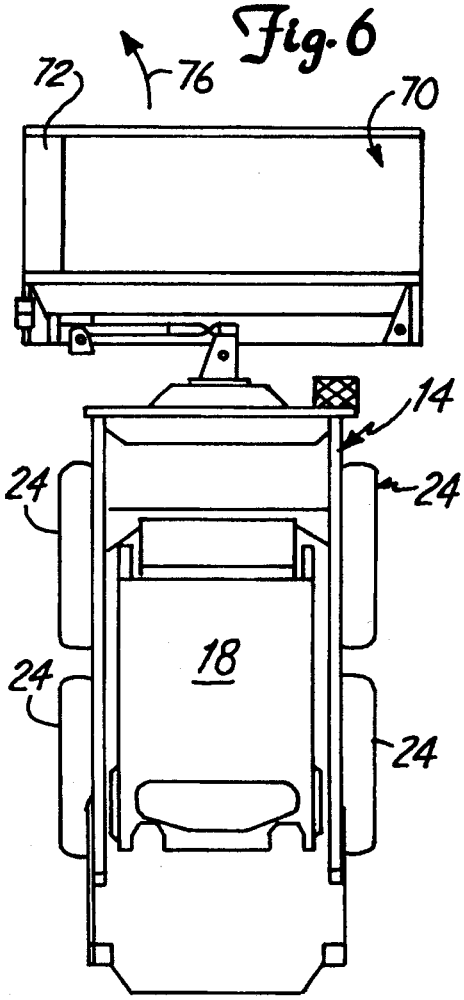
FIG. 6 is a top plan view of the skid steer loader shown in FIG. 5.

FIGS. 5 and 6 show another embodiment of loader 10 in which the stabilizers 60 are removed and in which a front mounted attachment, in the form of angle broom 70, is mounted to lift arm 14. Angle broom 70 typically carries a hydraulic motor 72 which powers rotation of brush 74 of angle broom 70. Motor 72 receives hydraulic power from hoses which are coupled to the front auxiliary control valves at hose couplings 42 (shown in FIG. 2). Further, broom 70 is typically pivotably mounted to life arm 14 so that it can be rotated about an arc generally indicated by arrow 76. This allows broom 70 to sweep at an angle relative to the direction of travel of loader 10. Rotation of angle broom 70 about arc 76 is preferably accomplished by an electrically powered screw-drive motor (not shown) mounted on broom 70.

In prior skid steer loaders, operator levers 13R and 13L typically included hand grips which had actuable operator input switches used to control the front and rear auxiliary control valves. The control valves were operated in a full on or full off manner. In other words, if the operator switched on one of the front or rear auxiliary control valves, the valve was completely opened allowing full flow of hydraulic pressure through the valve. If the corresponding switch were turned off, the valve would be completely closed resulting in zero hydraulic fluid flow through the valve. This resulted in discontinuous operation of the particular attachment being controlled by the front or rear auxiliary hydraulic control valves.

Further when certain front or rear mounted attachments were used on the conventional loader, and when a certain combination of operator inputs was provided by the operator input switches, this could result in the solenoids associated with opposing hydraulic control valves being energized. In other words, by way of example, if angle broom 70 were mounted to loader 10, and using a prior hydraulic controller, a certain combination of operator inputs provided by the switches located on the hand grips of levers 13L and 13R could cause both of the front auxiliary control valves to be open. This, in turn, would essentially cause opposing hydraulic pressures to be applied to motor 70 which would stop the motor. This would result in a stoppage of the rotation of brush 74. This typically resulted because the operator input switches were simply hardwired to corresponding solenoids associated with the auxiliary control valves.

Further, in prior systems, since the switches were typically hardwired to the corresponding solenoids, there was no efficient way of assigning desired operations to desired operator input switches when the front or rear mounted attachments were changed. In other words, there was no efficient way of reassigning the functions to different operator input switches based on the type of attachments which were mounted on the loader.

Figure 7:
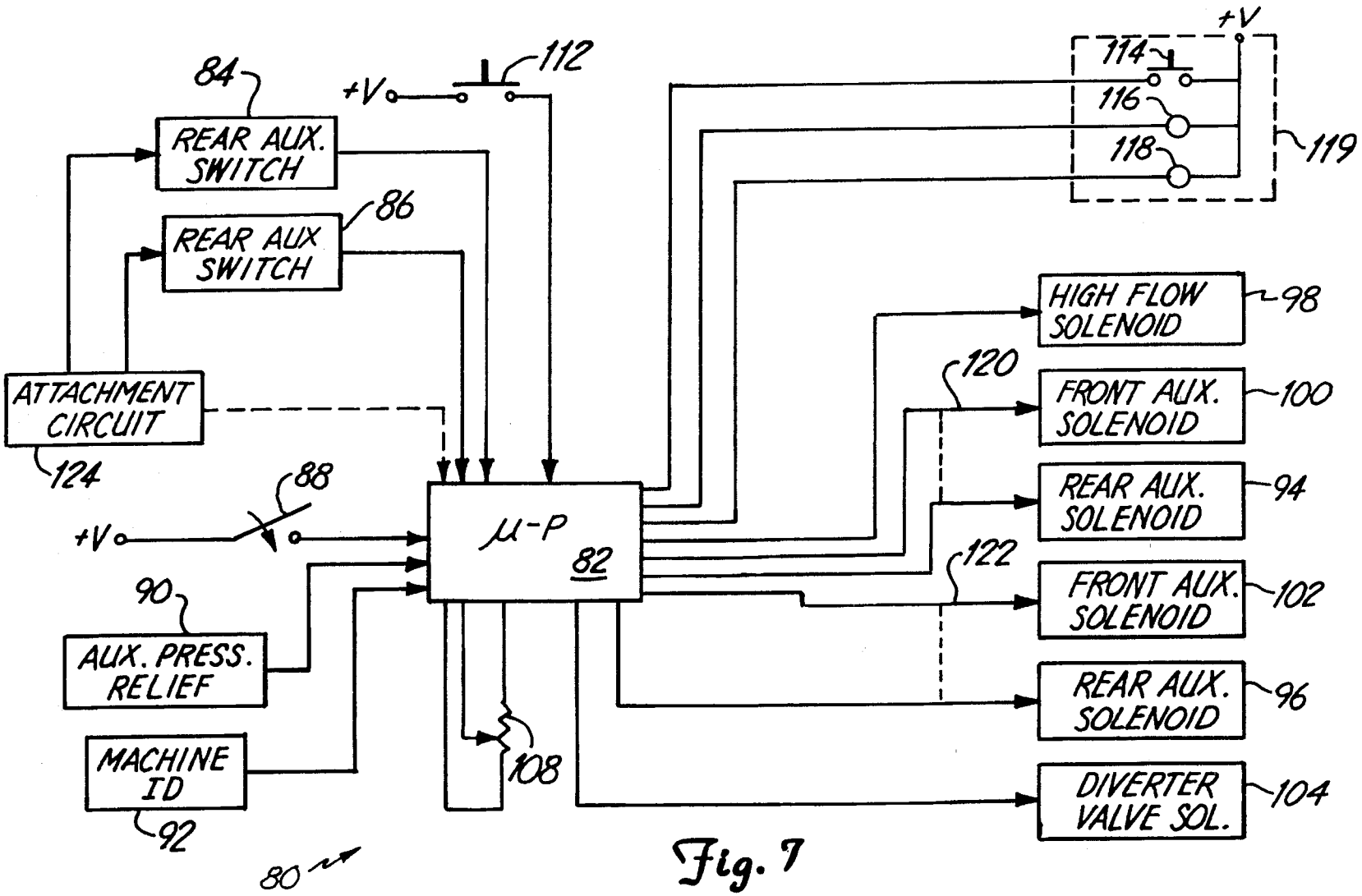
FIGS. 7 and 7A are block diagrams of an auxiliary control system according to the present invention.
Figure 7A:
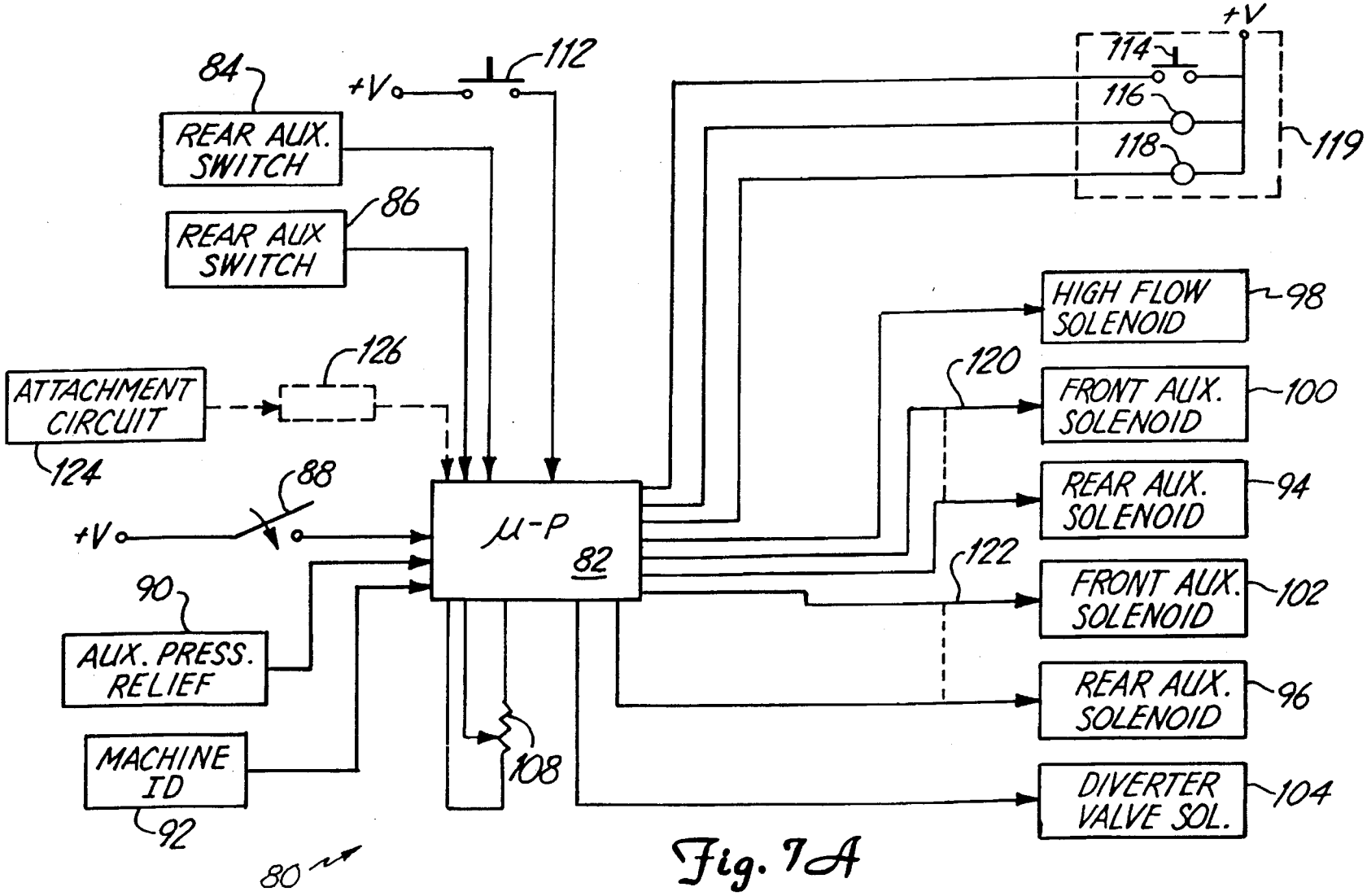

By contrast, the control system of the present invention addresses all of these concerns. FIG. 7 is a block diagram of control system 80 according to the present invention. Control system 80 includes microprocessor 82, first rear auxiliary switch 84, second rear auxiliary switch 86, ignition switch 88, auxiliary pressure relief input 90, machine identification input 92 first and second rear auxiliary solenoids 94 and 96, high flow solenoid 98, first and second front auxiliary solenoids 100 and 102, diverter valve solenoid 104, input potentiometer 108, detente button 112, mode button 114, momentary LED 116, and detente LED 118. In a preferred embodiment, detente button 112, mode button 114, momentary LED 116 and detente LED 118 are all located on an operator display panel 119.

Ignition switch 88 is preferably any suitable type of key ignition switch, or keyless ignition switch. When switch 88 is closed, a positive voltage potential is provided to microprocessor 82 indicating that microprocessor 82 should power up control system 80.

Solenoids 94, 96, 98, 100, 102, and 104 are electrically actuated solenoids which control corresponding hydraulic control valves. The valves are movable between a full open and full closed position to either allow, or discontinue, hydraulic fluid flow through the valve. The solenoids 94–104 are controlled by electrical output signals from microprocessor 82.

Rear auxiliary switches 84 and 86 are preferably manually actuable rocker switches located on the hand grips of levers 13R or 13L. These switches either provide an input signal to microprocessor 82 or are directly wired to rear auxiliary solenoids 94, 96. In response to an input from one of switches 84 or 86, microprocessor 82 manipulates rear auxiliary solenoids 94 and 96.

Potentiometer 108, in the preferred embodiment, is a 5K Ohm, 160° rotational radius potentiometer. An input button attached to the wiper of the potentiometer is spring centered at a nominal value of 80° of potentiometer travel, with nominal travel of 40° rotation in either direction. A dead band for potentiometer 108 is preferably ±10° of travel from nominal center. As will be described in greater detail below, the operator manipulates potentiometer 108 to cause processor 82 to provide a modulated output signal having a varying duty cycle (which varies based on the signal from potentiometer 108) to continuously control an auxiliary solenoid between a full open and full closed position.

Input signals from potentiometer 108 are filtered to keep transients from generating erroneous operational conditions. In a preferred embodiment, a minimum signal duration of several milliseconds is required from potentiometer 108 before microprocessor 82 acts on the input signal. This essentially acts as a high frequency filtering mechanism which promotes proper operation without causing undue delay between an operator input and the output from processor 82. Also, in the preferred embodiment, microprocessor 82 is programmed to detect either an open or short circuit from potentiometer 108 and to take appropriate action.

Processor 82 has an output coupled to potentiometer 108 to provide power to potentiometer 108 under appropriate conditions described below.

Detente button 112 is preferably a push button actuable switch. When the operator pushes detente button 112, a positive voltage potential is applied to an input of microprocessor 82. Mode button 114 is preferably similar to detente button 112. When the operator depresses mode button 114, a positive voltage potential is provided to an input of microprocessor 82.

Momentary LED 116 and detente LED 118 are preferably commercially available light emitting diodes. Under proper operating conditions, microprocessor 82 sinks current from a positive voltage potential across LEDs 116 and 118 to illuminate the LEDs.

Auxiliary pressure relief input 90 is another operator actuable input. When activated, input 90 applies a positive voltage potential to microprocessor 82. When this occurs, microprocessor 82 energizes front auxiliary solenoid 102.

Machine identification input 92 is preferably a single bit input which indicates the size of the machine. The particular machine in which control system 80 is mounted can have a separate rear auxiliary hydraulic circuit providing separate hydraulic power to the rear auxiliaries, or a single auxiliary hydraulic power circuit which provides hydraulic power either to the front auxiliaries or to the rear auxiliaries. In the former case, both front and rear auxiliaries are simultaneously operable. In the latter case, where the machine contains only a single auxiliary hydraulic power circuit, a hydraulic diverter valve having corresponding solenoid 104 is provided and is selectively energizable by microprocessor 82. By controlling energization of the diverter valve solenoid 104, microprocessor 82 can direct the hydraulic power from the auxiliary hydraulic power circuit to either the front auxiliaries or to the rear auxiliaries.

Some skid steer loaders are also provided with a high flow feature. With this feature, an extra hydraulic control valve and corresponding solenoid 98 are provided in the hydraulic control circuit. When the extra hydraulic control valve is actuated, it provides additional hydraulic fluid under pressure to the auxiliary to which it is connected. In essence, the high flow solenoid 98, when actuated, adds hydraulic fluid flow to the auxiliary output, thereby providing a higher powered auxiliary output. In the embodiment shown in FIG. 7, high flow solenoid 98 is electrically actuable by an output provided from microprocessor 82.

Microprocessor 82 controls front auxiliary solenoids 100 and 102 in a pulse width modulated, or pulse frequency modulated, fashion. Essentially, microprocessor 82 controls solenoids 100 and 102 based on the input from potentiometer 108 in a continuous fashion. The initial duty cycle of the signals provided to solenoids 100 and 102 for front auxiliary operation is preferably provided when the wiper of potentiometer 108 is moved just beyond the dead band (±10° rotation). The initial duty cycle is preferably a 50% duty cycle. The maximum duty cycle for the signals provided to solenoids 100 and 102 is preferably provided when the wiper of potentiometer 108 is at the extreme end of travel of the potentiometer. At the end of travel in either direction, microprocessor 82 provides pulse width or pulse frequency modulated signals to solenoids 100 and 102 which have a 100% duty cycle (i.e., a positive DC voltage).

In the preferred embodiment, the pulse width or frequency modulated signals have a constant on-time pulse width and a variable off-time pulse width. The variation of the off-time of the signal provides the variable frequency signal necessary for desired proportional control of solenoids 100 and 102. If a 100% duty cycle signal is provided to either solenoid 100 or 102, the control valve associated with the solenoid is in the full open position. By contrast, if a 0% duty cycle signal is provided to either solenoid 100 or 102, the corresponding control valve is in the full closed position. The position of the associated control valves changes continuously as the duty cycle of the input signal provided to solenoids 100 and 102 by microprocessor 82 changes. In this way, the front auxiliaries provide more smooth transitioning between full on and full off states, and also provide more smoothly controllable outputs, with finer control resolution.

When the particular attachment connected to the front auxiliaries requires a high flow output, high flow solenoid 98 is actuated. In the preferred embodiment, microprocessor 82 monitors the input from potentiometer 108. When the signal from potentiometer 108 indicates that modulated outputs 120 or 122 (in the present case output 122) should have in excess of an 85% duty cycle, microprocessor 82 determines that the high flow solenoid 98 should be energized. Thus, low or normal flow operation is provided when the modulated signal on output 122 is operated to have a duty cycle between 50% and 85%, and high flow control is performed when the modulated signal on output 122 has a duty cycle greater than 85%.

Another mode of operation which is sometimes desirable is referred to as the detente mode. Depending upon the particular attachment mounted to loader 10, it may be desirable to have a continuous output on one of the modulated outputs 120 or 122, without the need for the operator to continuously hold the switch connected to the wiper of potentiometer 108 in a given position. For example, where the front attachment is auger 32, or angle broom 70, it is desirable that the operator should only be required to provide one input, or one series of inputs, and have the auger 32 or broom 70 continue to rotate, without the operator being required to continuously hold the switch connected to the wiper of potentiometer 108 in a certain position. Therefore, detente button 112 and mode button 114 are provided. Further, LEDs 116 and 118 are provided to indicate both the mode of operation and certain diagnostics.

When ignition switch 88 is turned from the off-position to the on-position, microprocessor 82 is powered up with both LEDs 116 and 118 turned off. When mode button 114 is depressed a first time ignition switch 88 is closed), microprocessor 82 turns on LED 116 indicating that the front auxiliaries will operate in the momentary (or pulse width modulated) mode. Microprocessor 82 energizes the output which provides power to potentiometer 108. Thus, both the front and rear auxiliary control valves are operational and can be controlled by microprocessor 82. In this momentary operational mode, while the button connected to the wiper of potentiometer 108 is pressed (thereby rotating the wiper beyond its dead band region) microprocessor 82 controls solenoids 100 and 102 so that fluid flows in the appropriate direction and at the controlled rate through the control valves associated with solenoids 100 and 102.

When mode button 114 is depressed by the operator a second time, microprocessor 82 turns on LEDs 116 and 118 indicating that both the momentary and detente functions are operational. In this mode, momentary operation is performed by microprocessor 82 until the operator depresses the detente button 112 once. Depressing detente button 112 once provides a pulse signal to microprocessor 82 which indicates that the operator desires microprocessor 82 to perform a detente function. When this pulse is received, microprocessor 82 provides a 100% duty cycle signal on one of modulated outputs 120 or 122. In the present case, the 100% duty cycle output is provided on output 122. This 100% duty cycle signal will be provided even if the operator releases the wiper of potentiometer When the detente button 112 is depressed by the operator a second time, output 122 to solenoid 102 is turned off. Therefore, the operator can simply have microprocessor 82 toggle on or off the detente function by repeatedly depressing detente button 112.

When mode button 114 is depressed by the operator a third time, microprocessor 82 powers down control system 80 and turns off both LEDs 116 and 118. In this state, both the momentary and detente functions are inactive.

When potentiometer 108 is implemented in a hand grip of one of levers 13L and 13R, calibration is an important feature. Mechanical components of such hand grips typically have an estimated tolerance of ±10%. Further, the tolerance of a standard commercially available potentiometer such as potentiometer 108 may typically be in the range of ±10%. Therefore, the tolerance for the entire handle assembly including potentiometer 108 and the mechanical switches used with potentiometer 108, is assumed to be ±22.5°. Because of this tolerance, a calibration procedure is desirable to initialize the system.

Calibration according to one embodiment of the invention provides that microprocessor 82 first verifies that the wiper for potentiometer 108 (when first powered up and in the neutral position) is at approximately the center of potentiometer 108 (within ±22.5°). If the potentiometer 108 is outside this range, a calibration error warning is initiated by microprocessor 82. In the preferred embodiment, microprocessor 82 controls LEDs 116 and 118 to alternately blink on and off to indicate a potentiometer calibration problem.

During a normal run cycle, when mode button 114 is depressed a first time, microprocessor 82 again checks potentiometer 108 to assure adherence to the ±22.5°tolerance range. If potentiometer 108 is still within the tolerance range, the current position of the wiper of potentiometer 108 is set as the center position, and the control bands associated with potentiometer 108 are calculated as being 40° on either side of the new center position. Proportional valve solenoids 100 and 102 are now operational and proportional control can be provided to solenoids 100 and 102.

On each subsequent depression of mode button 114 (e.g., when the operator cycles through the detente mode and the activation/deactivation mode) during a run cycle, microprocessor 82 checks the current position of the wiper of potentiometer 108 to ensure that it is within ±2.5° of the previous centerpoint. If so, microprocessor 82 sets the current position of the wiper of potentiometer 108 as the new center position. If the new center position of the wiper of potentiometer 108 eventually migrates out of the major tolerance range (±22.5° of rotational tolerance), microprocessor 82 controls LEDs 116 and 1.18 to indicate a calibration problem.

It should be noted that, in the preferred embodiment, even if a calibration error occurs, the other functions of control system 80 are operational. The only function which is disabled is the proportional front auxiliary control function. In other words, by using other switches on the control handle, solenoids 100 and 102 are still operable in a full open or full closed fashion. They are simply not operable to accomplish proportional operation.

Additional diagnostics are performable by microprocessor 82. If microprocessor 82 determines that any of solenoids 100, 102 or 104 are operating incorrectly, microprocessor 82 controls LEDs 116 and 118 to blink in a predetermined pattern indicating the problem. In the preferred embodiment, if microprocessor 82 determines that solenoid 100 is operating improperly, microprocessor 82 controls LED 116 to blink, and turns off LED 118. If microprocessor 82 determines that solenoid 102 is operating improperly, microprocessor 82 turns off LED 116 and causes LED 118 to blink. If microprocessor 82 determines that diverter valve solenoid 104 is operating improperly, microprocessor 82 causes both LEDs 115 and 118 to blink. By knowing the predetermined blink pattern of LEDs 116 and 118, an operator can easily identify the problem indicated by microprocessor 82.

FIG. 7 also illustrates the capability of microprocessor 82 to receive an input from a particular attachment mounted on loader 10. In FIG. 7, an attachment circuit 124 is shown. Attachment circuit 124 is preferably physically mounted on a particular attachment which is, in turn, mounted on loader 10. Attachment circuit 124 provides either a separate input through an attachment input coupling 126 to microprocessor 82, or is hardwired to pre-existing input switches (such as rear auxiliary input switches 84 and 86) which provide input signals to microprocessor 82. Based on the particular attachment input signal received, microprocessor 82 controls circuit 80 in a desired fashion. For example, in one preferred embodiment, where the attachment is angle broom 70, attachment circuit 124 simply hardwires the inputs to microprocessor 82 from switches 84 and 86 together and ties them to a positive voltage potential. When microprocessor 82 receives these signals, this indicates to microprocessor 82 that the attachment mounted to loader 10 is the angle broom 70. This enables microprocessor 82 to assign particular functions to the various other operator control inputs so that the angle broom 70 is operated correctly.

In another embodiment, attachment circuit 124 provides parallel input signals through attachment output connector 126 to microprocessor 82. The parallel input signals have a unique pattern which specifically identifies the type of attachment mounted on loader 10.

In yet another embodiment, attachment circuit 124 is responsive to operator inputs and only then provides the attachment signal to microprocessor 82. In other words, in the embodiment in which attachment circuit 124 hardwires switches 84 and 86 together, the circuit is configured so that only when the operator actuates one of switches 84 and 86 will the positive voltage potential be applied to the inputs of microprocessor 82 from switches 84 and 86. Attachment circuit 124 essentially electrically energizes a second input (from either switch 84 or 86) to microprocessor 82 when a first input (from the other of switches 84 and 86) to microprocessor 82 is being energized by the operator.

The following discussion illustrates operation of control system 80 in both the momentary mode, and the detente mode in machines which allow either operation of front or rear auxiliaries and in machines which allow operation of both front and rear auxiliaries simultaneously.

In machines which allow only the front or rear auxiliaries to be operated, if the circuit 80 is placed in the momentary mode (by a first depression of de button 114 ) then the following operational characteristics apply. Detente button 112 is inoperable. Therefore, if the operator depresses detente button 112, no action is taken by microprocessor 82.

If the wiper of potentiometer 108 is moved in either direction beyond its dead band, the appropriate duty cycle (or proportional signal) is provided to one of solenoids 100 and 102 along outputs 120 and 122. If either of the rear auxiliary switches 84 or 86 are depressed, the microprocessor 82 provides a 100% duty cycle to diverter valve solenoid 104 diverting hydraulic power to the rear auxiliary. Microprocessor 82 also actuates rear auxiliary solenoids 94 and 96. It should also be noted that the hydraulic circuit can be configured so that the diverter valve associated with diverter valve solenoid 104 is downstream of solenoids 100 and 102. Therefore, solenoids 100 and 102 can be used to control front or rear auxiliaries, depending upon the state of diverter valve solenoid 104. In that case, if solenoids 100 and 102 are used to control both front and rear auxiliaries, and one of rear switches 84 and 86 are depressed while the machine is in the momentary mode, the microprocessor 82 provides a 100% duty cycle output on a selected one of outputs 120 and 122 and a 100% duty cycle signal to diverter valve solenoid 104. This effectively provides full on and full off operation to the rear auxiliaries.

It should also be noted, in this mode of operation, rear auxiliaries take precedence when conflicting inputs are received. In other words, if a rear auxiliary switch 84 or 86 is depressed providing an input to microprocessor 82, and if potentiometer 108 is providing an input to microprocessor 82 indicating that the front auxiliary should be operated, the front auxiliary operation is discontinued and microprocessor 82 services the rear auxiliary operation request.

When the operator depresses the mode button 114 a second time so that control system 80 enters the detente mode, the detente button 112 acts as a toggle switch causing microprocessor 82 to alternately provide its outputs in a detente (or continuous) manner. Therefore, if the detente button 112 is depressed, a 100% duty cycle signal is provided on output 122 assuming that the prior state of the detente function was off. If the prior state of the detente function was on, then power to output 122 is turned off.

If the detente function is activated, and potentiometer 108 is moved to request a modulated output on output 120, then the 100% duty cycle signal on output 122 is turned off and solenoid 100 is operated in the desired proportional manner. When potentiometer 108 is released, and thereby the requested operation of solenoid 100 is discontinued, then the detente output (100% duty cycle signal on output 122 to solenoid 102) is resumed.

When in the detente mode and either of the rear auxiliary switches 84 or 86 are activated, microprocessor 82 discontinues operation of the front auxiliaries and services the requested operation for the rear auxiliaries. If the front auxiliary was previously in detente mode, then that detente mode is resumed once the requested operation for the rear auxiliaries ceases.

In machines in which both front and rear auxiliaries are operable at the same time, and in which the high flow capability is present, the following operations occur. When the machine is in the momentary mode and the detente button is pressed, no action is taken. When potentiometer 108 is moved beyond its dead band in one direction or the other, the appropriate duty cycle output signal is provided along a selected one of outputs 120 and 122 to the appropriate solenoid. If the requested duty cycle is greater than 85%, then the high flow output is energized so that high flow solenoid 98 is energized. If both front and rear auxiliary operations are requested, both are serviced.

In one embodiment, the rear auxiliary switches 84 and 86 are hard wired to rear auxiliary solenoids 94, 96 so that, no matter whether the front auxiliary solenoids are energized by microprocessor 82, the rear auxiliary solenoids are also energizable by the hard wired connection to switches 84 and 86. Further, energization of the rear auxiliary solenoids 94 and 96 does not affect the high flow control of the front auxiliary solenoids. In other words, regardless of whether the rear auxiliary solenoids are energized, if the front auxiliary solenoids are energized by a signal having a duty cycle in excess of 85%, then the high flow solenoid 98 is energized to provide high flow control to the front auxiliaries.

Operation in the detente mode is highly similar except that, if the detente button is pushed, and the previous state of the detente function was off, then a 100% duty cycle signal is provided to the appropriate output (in the present case output 122) and to the high flow output energizing high flow solenoid 98. If the high flow output and output 122 are receiving 100% duty cycle signals in the detente mode, and if potentiometer 108 is manipulated to request an output signal on output 120, then the solenoids 98 and 102 are de-energized and solenoid 100 is proportionally controlled in a desired fashion. When potentiometer 108 is released, then the detente mode is resumed and solenoids 98 and 102 are again provided with 100% duty cycle output signals. Again, as in the momentary mode, requests for the rear auxiliaries are serviced regardless of requests for the front auxiliaries.

It can be seen that, with the various embodiments of the present invention, a number of significant advantages are obtained. First, control microprocessor 82 provides the ability to modulate the oil flow through any number of auxiliary control valves. In the embodiment described herein, modulated outputs are provided to the front auxiliary control valves to modulate oil flow in response to an input from potentiometer 108. By providing the appropriate modulated output signal, microprocessor 82 can essentially control the hydraulic control valves to be at any position between full open and full closed thereby providing smoother operation of attachments mounted on loader 10.

Further, the present invention allows circuit 80 to be used with machines having a high flow feature. When potentiometer 108 is moved outside of a predetermined range, and thereby requests a modulated output signal having a duty cycle above a predetermined threshold, the high flow feature is enabled and solenoid 98 is energized.

In addition, control system 80 prioritizes input operations received. Thus, if two opposing input operations are requested by an operator (for example if the operator depresses more than one input switch at a time and thereby requests opposing operations) microprocessor 82 determines which of the requested operations is to be serviced based on a predetermined priority.

Also, attachment circuit 124 is provided on the attachments, and microprocessor 82 is suitable for receiving an input from attachment circuit 124. Based on this input, microprocessor 82 can interpret operator input requests and perform desired functions usable with the specific attachment mounted to loader 10. By assigning certain operations to certain operator input devices, based on the specific attachment mounted on loader 10, control of the attachment is accomplished in a highly efficient manner. Therefore, each operator input device can indicate one of any number of control operations, depending upon the particular attachment mounted on loader 10.

The present invention also provides diagnostic capability. Microprocessor 82 is suitably programmed to monitor the states of various solenoids and other control system components in circuit 80. By controlling LEDs 116 and 118 to blink in predetermined patterns, microprocessor 82 can communicate various problems to the operator in a diagnostic fashion.

Although the present invention has been described with reference to preferred embodiments, workers skilled in the art will recognize that changes may be made in form and detail without departing from the spirit and scope of the invention.

What is claimed is:

1. A skid steer loader, comprising:

a frame;

a plurality of ground engaging wheels supporting the frame;

an operator compartment supported by the wheels;

an engine operably coupled to the wheels;

a lift arm coupled to the frame; and a control system including:

a hydraulic circuit providing a fluid under pressure;

a plurality of control valves coupled to the hydraulic circuit;

a plurality of operator input devices, each operator input device, when activated, providing an input signal indicating a desired operation; and an electronic controller coupled to the operator input devices and the control valves, the electronic controller controlling the control valves such that, when the plurality of operator input devices are activated to indicate a plurality of desired and conflicting operations, only one of the plurality of desired and conflicting operations are performed according to a predetermined priority.

2. The skid steer loader of claim 1 and further comprising:

an attachment mount for mounting a hydraulically powerable attachment to a portion of the skid steer loader.

3. The skid steer loader of claim 1 wherein the plurality of control valves comprise:

auxiliary control valves, couplable to the attachment, for providing the fluid under pressure to the attachment to accomplish the desired operations.

4. The skid steer loader of claim 3 wherein the electronic controller controls according to the predetermined priority by diverting hydraulic power to desired hydraulic control valves.

5. A skid steer loader, comprising:

a frame;

a plurality of ground engaging wheels supporting the frame;

an operator compartment supported by the wheels;

an engine operably coupled to the wheels;

a lift arm coupled to the frame; p1 an attachment mount coupled to a portion of the skid steer loader;

an attachment removably coupled to the skid steer loader by the attachment mount;

a control system including:

an attachment circuit providing an attachment signal indicative of allowable operations useable with the attachment;

a hydraulic circuit providing a fluid under pressure.

a plurality of auxiliary control valves coupled to the hydraulic circuit and the attachment;

a plurality of operator input device, when each operator input device, when activated, providing an input signal indicating a desired operation; and an electronic controller coupled to the operator input devices, the attachment circuit and the control valves, the electronic controller controlling the control valves based on the input signals from the operator input devices and based on the attachment signal.

6. The skid steer loader of claim 5 wherein the attachment circuit provides the attachment signal in response to an input signal from at least one of the plurality of operator input devices.

7. The skid steer loader of claim 5 wherein the attachment circuit comprises:

a hardwired connection between one of the plurality of operator input devices and the electronic controller.

8. A skid steer loader, comprising:

a frame;

a plurality of ground engaging wheels supporting the frame;

an operator compartment supported by the wheels;

an engine operably coupled to the wheels;

a lift arm coupled to the frame;

an attachment mount coupled to a portion of the skid steer loader;

an attachment removably coupled to the skid steer loader by the attachment mount;

a control system including:

an attachment circuit providing an attachment signal indicative of the attachment;

a hydraulic circuit providing a fluid under pressure;

a plurality of auxiliary control valves coupled to the hydraulic circuit and the attachment;

a plurality of operator input devices, each operator input device, when activated, providing an input signal indicating a requested operation; and an electronic controller coupled to the operator input devices, the attachment circuit and the control valves, the electronic controller controlling the control valves to perform the request operations, wherein the requested operations performed are associated with particular operator input signals based on the attachment indicated by the attachment signal.

9. The skid steer loader of claim 8 wherein the attachment signal provided by the attachment circuit comprises:

an attachment identification signal identifying a particular attachment type.

10. The skid steer loader of claim 9 wherein the controller associates particular operations with each of the plurality of operator input devices based on the attachment type.

* * * * *

UNITED STATES PATENT AND TRADEMARK OFFICE

CERTIFICATE OF CORRECTION

PATENT NO. : 5,590,731

DATED : January 7, 1997

INVENTOR(S) : Scott B. Jacobson

It is certified that error appears in the above-indentified patent and that said Letters Patent is hereby corrected as shown below:

Column 12, line 59, delete "p1 an attachment mount".

Column 12, line 60, insert --an attachment mount-- before "coupled".

Column 13, line 4, delete "device, when" and insert --devices,--.

Signed and Sealed this

Twenty-fourth Day of June, 1997

Bruce Lehman

*Attest:*

BRUCE LEHMAN

*Attesting Officer*

*Commissioner of Patents and Trademarks*